US005300260A

United States Patent [19]

Keshet et al.

[11] Patent Number: 5,300,260

[45] Date of Patent: Apr. 5, 1994

[54] FOG GENERATOR

[75] Inventors: Amiram Keshet, Rehovot; Yaacov Shoham, Doar Beer Yaacov, both of Israel

[73] Assignee: Shira Aeroponics (1984) Ltd., Rehovot, Israel

[21] Appl. No.: 49,381

[22] Filed: Apr. 21, 1993

[30] Foreign Application Priority Data

May 22, 1992 [IL] Israel ..... 101967
Dec. 25, 1992 [IL] Israel ..... 104231

[51] Int. Cl.[5] ..... B01F 3/04

[52] U.S. Cl. ..... 261/81; 261/DIG. 48; 239/182.2

[58] Field of Search ..... 261/DIG. 48, 81; 239/102.2

[56] References Cited

U.S. PATENT DOCUMENTS 4,731,204 3/1988 Noma et al. ..... 261/DIG. 48
4,776,990 10/1988 Verity ..... 261/DIG. 48
4,911,866 3/1990 Monroe ..... 261/DIG. 48

FOREIGN PATENT DOCUMENTS 3516144 11/1986 Fed. Rep. of Germany .
0034113 3/1979 Japan ..... 239/102.2
0129541 7/1985 Japan ..... 261/DIG. 48

OTHER PUBLICATIONS

Patent Abstracts of Japan vol. 004, No. 030 (C-002) 15 Mar. 1980 & JP-A-55 005 760 (Nomura Sangyo KK) 30 Jun. 1978.

*Primary Examiner*—Tim Miles
*Attorney, Agent, or Firm*—Benjamin J. Barish

[57] ABSTRACT

A fog generator includes a reservoir for a liquid to be atomized, a plurality of ultrasonic transducers disposed in spaced relation to each other in the reservoir so as to be submerged within the liquid therein, a gas inlet duct extending through the reservoir, and a dome-shaped deflector overlying, and of larger diameter than, the gas inlet duct to deflect the gas flowing through the duct back towards the reservor to pick up liquid atomized by the transducers.

19 Claims, 5 Drawing Sheets

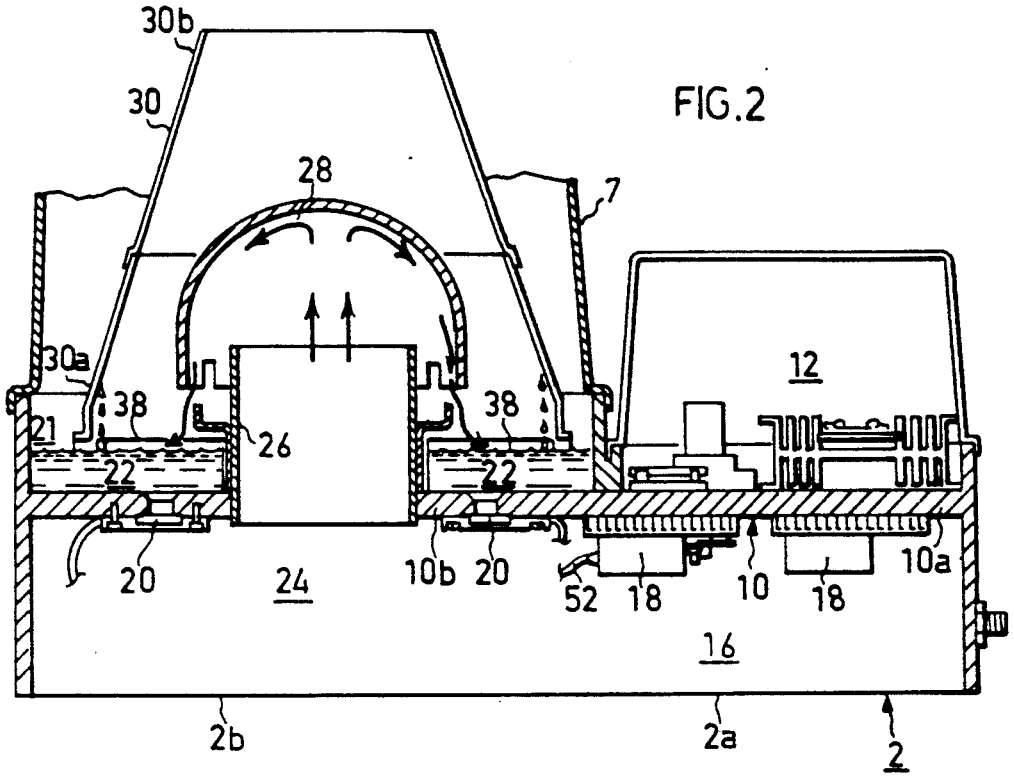
FIG. 2
FIG. 3
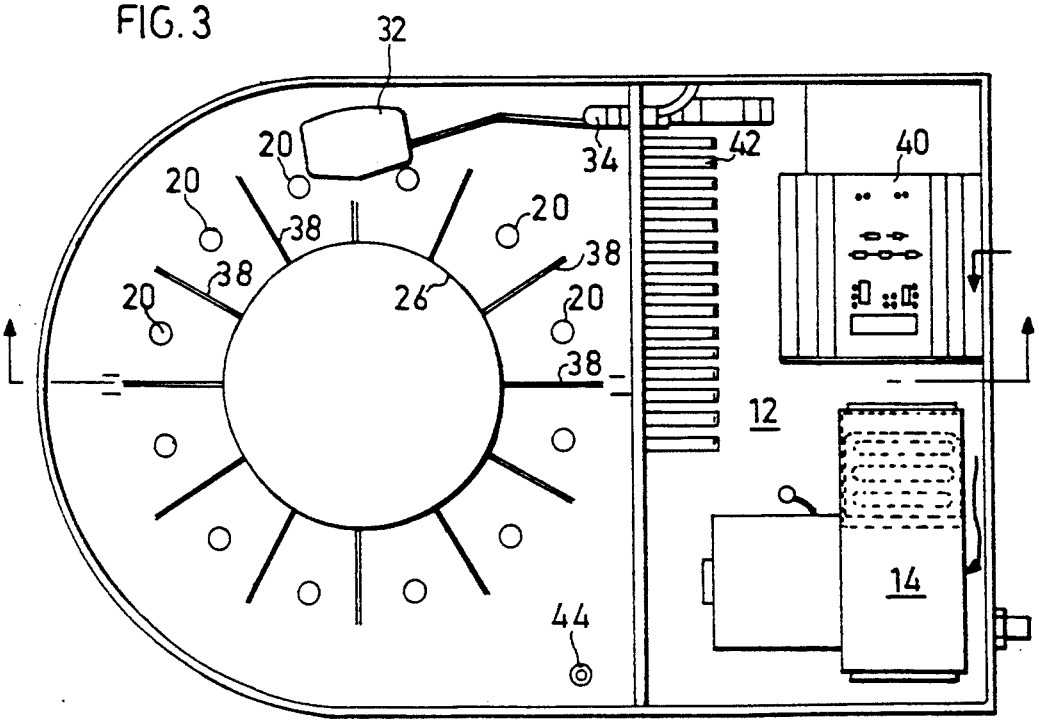

FOG GENERATOR

FIELD AND BACKGROUND OF THE INVENTION

The present invention relates to a fog generator, and particularly to one useful in horticulture for growing plants aeroponically, or conventionally.

The invention is particularly useful in the fog-generator method for growing plants aeroponically (i.e. in air, rather than in soil), such as described in our prior U.S. Pat. No. 5,136,804. In such a method, the plant roots, and also the shoots and foliage, are subjected to a fog of atomized water, which may include other additives such as fertilizers, fungicides, etc. Utilizing a fog generator has a number of advantages over a water sprayer. Thus, when sprayers are used, they supply water at a relatively high rate so they must be intermittently operated, whereas a fog generator, supplying water at a much lower rate, can be continuously operated. As a result, utilizing a fog generator reduces the possibility of "stress drying" or "salting" of the plants which may occur in sprayer systems during the periods when the sprayers are not operated.

OBJECT AND BRIEF SUMMARY OF THE INVENTION

An object of the present invention is to provide a fog generator which can efficiently supply copious quantities of finely atomized liquid, or fog.

According to one aspect of the present invention, there is provided a fog generator, comprising: a housing including a reservoir for a liquid to be atomized; a plurality of ultrasonic transducers disposed in spaced relation to each other in the reservoir so as to be submerged within the liquid therein; and gas directing means for directing a flow of gas across the liquid in the reservoir; the gas directing means including a gas inlet duct extending through the reservoir, and a dome-shaped deflector overlying, and of larger diameter than, the gas inlet duct to deflect the gas flowing through the duct back towards the reservor to pick up liquid atomized by the transducers.

According to another aspect of the present invention, there is provided a fog generator, comprising: a housing including a reservoir for a liquid to be atomized; a plurality of ultrasonic transducers disposed in spaced relation to each other in the reservoir so as to be submerged within the liquid therein; gas directing means for directing a flow of gas across the liquid in the reservoir; and a plurality of baffles fixed in the reservoir in the spaces between the ultrasonic transducers to act as barriers suppressing the formation of waves in the liquid between the ultrasonic transducers. The ultrasonic transducers are disposed in a circular array and the baffles are also disposed in a circular array between the ultrasonic transducers.

As will be described more particularly below, a fog generator constructed in accordance with the foregoing features can efficiently produce large quantities of fog, particularly useful in horticulture for aeroponically growing plants. The fog produced by such a generator may have an average particle size of about five microns, such that the fog effectively penetrates all the spaces in the roots of the plants in the aeroponic enclosure and, if desired, also in the shoots and foliage of such plants, as described for example in the above-cited patent application.

Further features and advantages of the invention will be apparent from the description below.

BRIEF DESCRIPTION OF THE DRAWINGS

The invention is herein described, by way of example only, with reference to the accompanying drawings, wherein:

FIG. 2 is a sectional view of the fog generator of FIG. 1;

FIG. 3 is a top view of the fog generator of FIGS. 1 and 2 with parts removed to show internal structure;

DESCRIPTION OF PREFERRED EMBODIMENTS

The Embodiment of FIGS. 1–5

Figure 1:
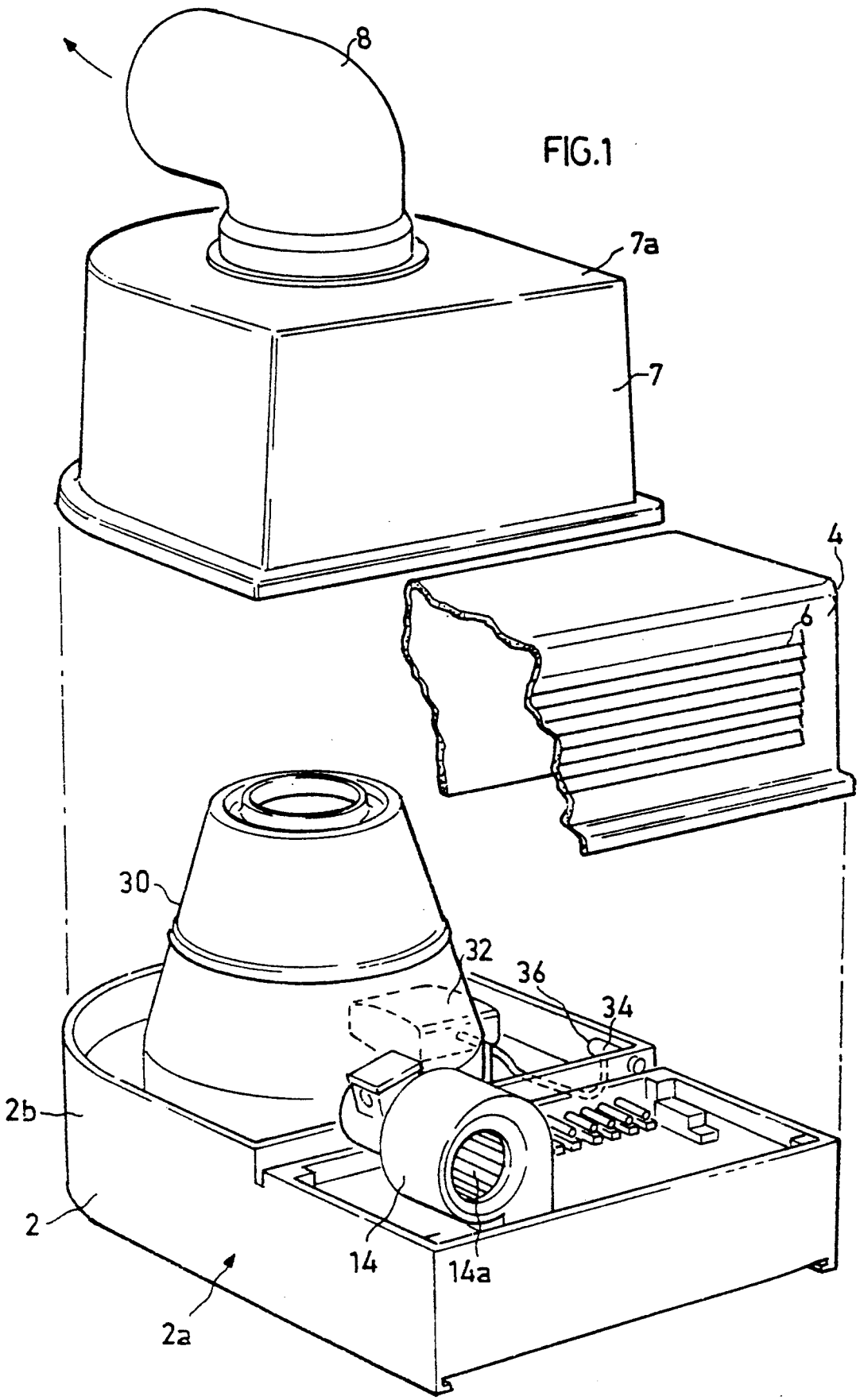
FIG. 1 is a three-dimensional view, partly exploded and broken-away to show internal structure, of one form of fog generator constructed in accordance with a preferred embodiment of the present invention.
Figure 4:
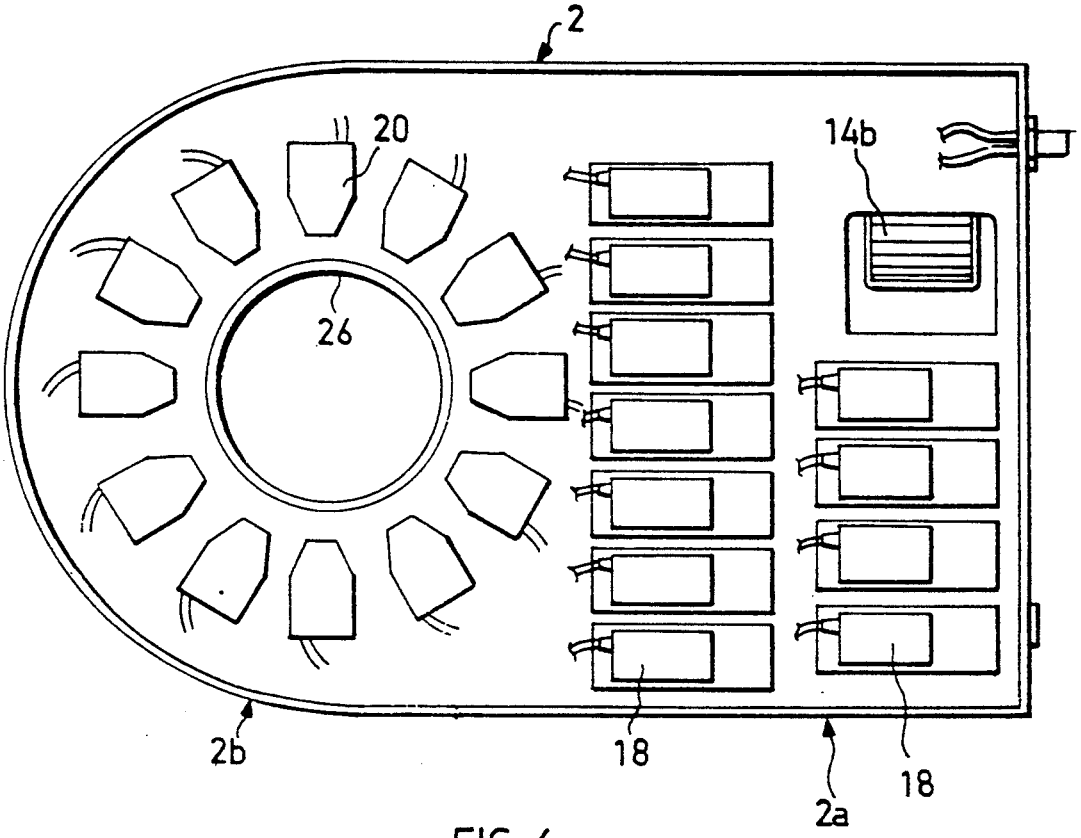
FIG. 4 is a bottom view of the fog generator of FIGS. 1 and 2.

The fog generator illlustrated in FIGS. 1–5 comprises a housing, generally designated 2, constituted of two sections: an air-blower section **2*a*, in which a flow of air (or other gas) is generated, and a fog generator section 2*b*, in which a fog is generated by means of ultrasonic transducers located in that section. The air blower section 2*a* is closed by a cover 4, having an inlet grid 6 through which the air is drawn into the apparatus. The fog generator section 2*b* is closed by a cover 7 having an outlet duct 8 through which the generated fog is discharged. The fog generated within the device and discharged via outlet duct 8** is particularly useful in horticulture for aeroponically or conventionally growing plants, but may be used in many other applications, such as humidifiers, nebulizers, and the like.

Housing 2 includes a horizontal partition 10. One part **10*a* of this partition divides the air-blower section 2*a* into an upper compartment 12 containing an air blower 14, and a lower compartment 16 containing a plurality of electrical drivers 18 for a plurality of ultrasonic transducers 20 included in the fog generator section 2*b*. A second part 10*b* of partition 10 divides the fog generator section 2*b* of the apparatus into an upper compartment 21 including a liquid reservoir 22 of annular configuration, and a lower compartment 24 communicating directly with compartment 16 of the air-blower section 2*a***.

The plurality of ultrasonic transducers 20 are fixed in a circular array to partition 10, such as to be immersed in the liquid within the liquid reservoir 22. A cylindrical air duct 26 passes through partition 10 centrally of the annular liquid reservoir 22 and the array of ultrasonic transducers 20. A dome-shaped deflector 28, of semi-spherical configuration, is fixed above the outlet end of air duct 26. The open end of deflector 28 is of larger diameter than air duct 26 such that the inner surface of the open end of the deflector projects outwardly of the air duct and overlies the inner end of the annular liquid reservoir 22. A conically-shaped outlet duct 30 is secured to the housing section 2*b*, with the larger-diameter end of the duct circumscribing the ultrasonic transducers 20 and overlying the outer end of the annular liquid reservoir 22. The outer, smaller-diameter end 30*b* of duct 30 is spaced below the upper end 7*a* of cover 7, to which is secured a cylindrical outlet duct 8, as shown in FIG. 1, for discharging the generated fog.

The liquid within the annular reservoir 22 is maintained at a constant level by a float 32 operating a valve 34 controlling the inletting of the water via an inlet tube 36 (FIGS. 1 and 3). Float 32 maintains the liquid at the optimum level within reservoir 22 to immerse all the ultrasonic transducers 20 which, when energized by their drivers 18, atomize the liquid. An annular array of baffles 38, fixed to partition 10 in the spaces between the ultrasonic transducers 20 and projecting above the level of the liquid within the reservoir 22, acts as barriers suppressing the formation of waves in the liquid when the blower 14 and the ultrasonic transducers 20 are operated.

Compartment 12, including the air blower 14, may also include a power supply 40 (FIG. 3) and a plurality of fuses 42 These electrical components, as well as the drivers 18 for the ultrasonic transducers 20 in compartment 16, are cooled by the air flow produced by blower 14. A reed switch 44 (FIG. 3) is floatingly mounted to turn-off the power supply, should the water level in the reservoir 22 drop below a minimum value, to protect the ultrasonic transducers 20.

The fog generator illustrated in the drawings operates as follows:

When air blower 14 is energized, it draws air via the inlet grid 6 in cover 4, causing the air to pass over the power supply 40 and the fuses 42 before reaching inlet 14*a* (FIG. 1) of the air blower. The air is discharged from the air blower through an outlet opening 14*b* (FIG. 4) in partition 10, into the lower compartment 16, and is circulated over the ultrasonic transducer drivers 18 before being directed to compartment 24 underlying the fog generator section 2*b* of the housing.

The air is passed through the inlet duct 26 centrally of the annular reservoir 22 and the circular array of ultrasonic transducers 20 immersed in the liquid in that reservoir. As shown by the arrows in FIG. 2, the air is then deflected by the inner surface of the dome-shaped deflector 28 back towards the liquid level within reservoir 22, and then transversely across the reservoir so as to become intimately mixed with the liquid atomized by the ultrasonic transducers 20. Baffles 38 between the ultrasonic transducers suppress the formation of waves.

The operation of the ultrasonic transducers 20 directs the atomized liquid upwardly towards the inner surface of the conical duct 30. Heavy particles of liquid tend to coalesce on the inner surface of the duct and drip back into reservoir 22, whereas the lighter particles, intimately mixed with the air, pass through the outlet opening 30*b* of duct 30 and through the cylindrical outlet duct 8.

Figure 5:
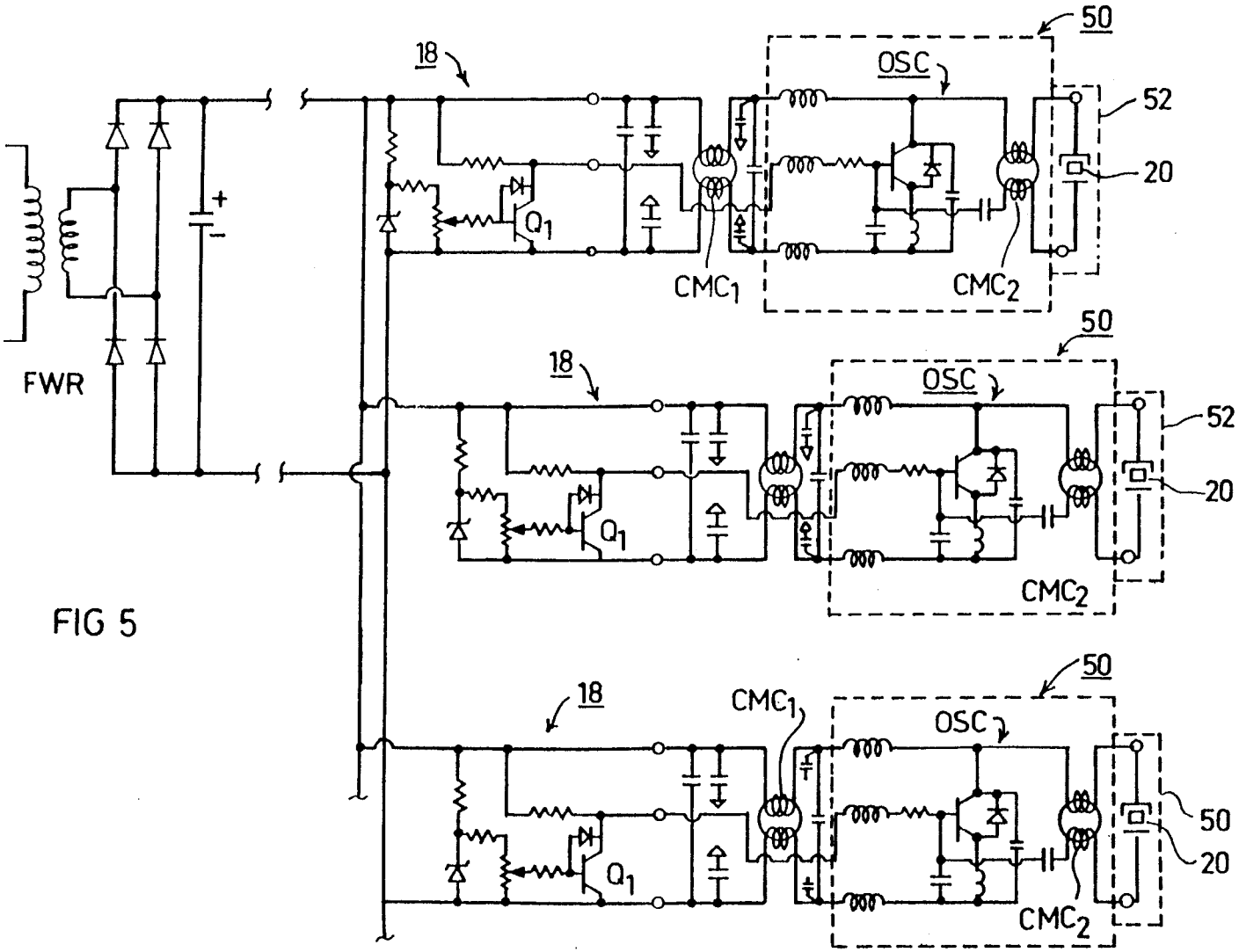
FIG. 5 is a diagram illustrating the electrical circuit in the fog generator of FIGS. 1–4.

FIG. 5 illustrates the electrical circuitry for driving the ultrasonic transducers 20. While the ultrasonic transducers 20 are immersed in the liquid within reservoir 22, their drivers 18 are disposed in the electrical circuitry compartment 16, remote from the transducers, so as to enable them to be cooled by the air from the blower 12 passing through compartment 16 before reaching the fog generator section 2*b* of the device. This arrangement also facilitates maintenance.

As shown in FIG. 5, the electrical circuitry includes a full-wave rectifier FWR which supplies, in parallel, the power to the drivers 18 for the ultrasonic transducers 20. Each driver 18 includes an oscillator OSC, outputting a voltage at the appropriate frequency (10 KHz–4.6 MHz) to the respective transducer 20. Each driver 18 further includes a transistor $Q_1$ which serves as a base-current regulator for its respective oscillator OSC. RFI (radio frequency interference) is suppressed by a plurality of capacitors and a common mode choke $CMC_1$ between the latter regulator and its respective oscillator OSC, and by a second common mode choke $CMC_2$ between the oscillator and its respective ultrasonic transducer 20.

The oscillator OSC for each ultrasonic transducer 20 is housed within a metal shielding box schematically illustrated by broken lines 50. As indicated earlier, each driver 18, including its oscillator within shielding box 50, is located in compartment 16 remote from its respective ultrasonic transducer 20 located in the liquid reservoir 22. Each ultrasonic transducer 20 is connected to its respective driver by a pair of wires enclosed within a shielding cable 52 (FIGS. 2 and 5) electrically connected to the metal shielding box 50 housing the oscillator OSC for the respective ultrasonic transducer.

The above electrical system provides a number of advantages: It permits the drivers 18 for the ultrasonic transducers 20 to be remotely located from the respective transducers and to be cooled by the gas flow from the blower 14. In addition, the illustrated circuitry maintains the electrodes of the ultrasonic transducers 20 which are in contact with the water all at the same potential, so as to prevent electrolysis of the water.

As indicated earlier, the fog generated by the described apparatus and discharged via the outlet duct 8 is particularly useful for aeroponically growing plants, but may be used in many other applications, e.g. humidifiers, nebulizers, etc. The gas may be air and/or other gases, such as carbon dioxide, nitrogen, or the like.

Figure 6:
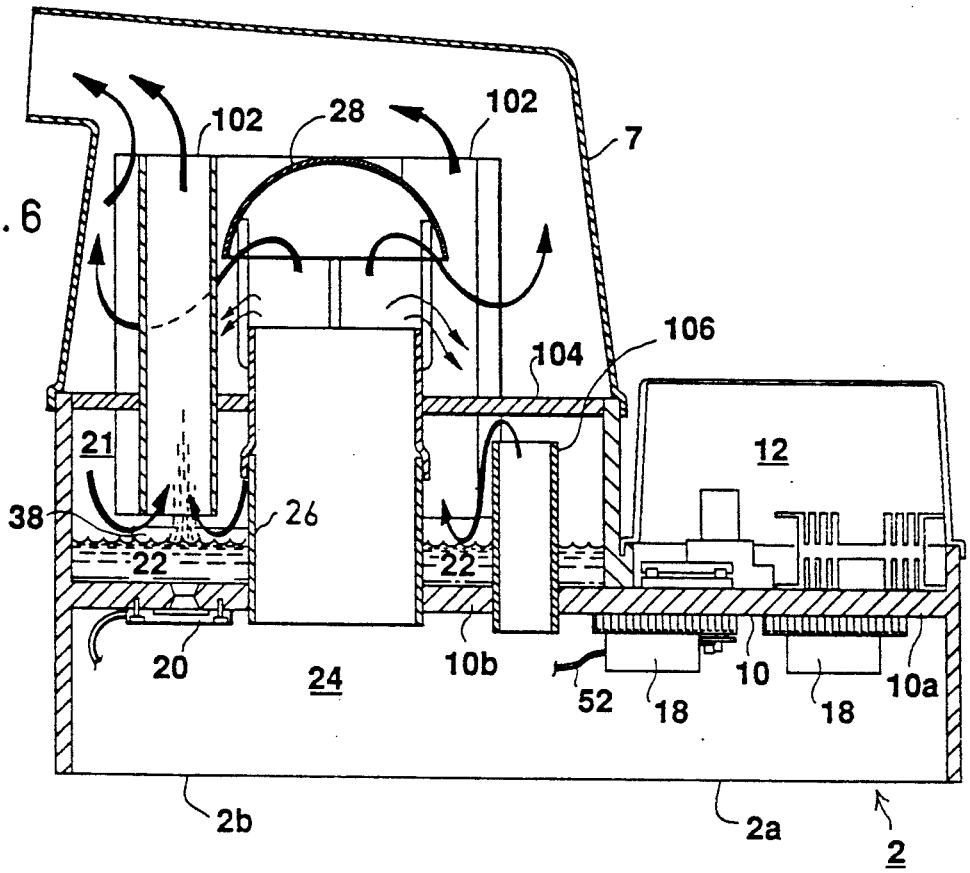
FIG. 6 is a view corresponding to FIG. 2 but illustrating another preferred embodiment of the invention.
Figure 7:
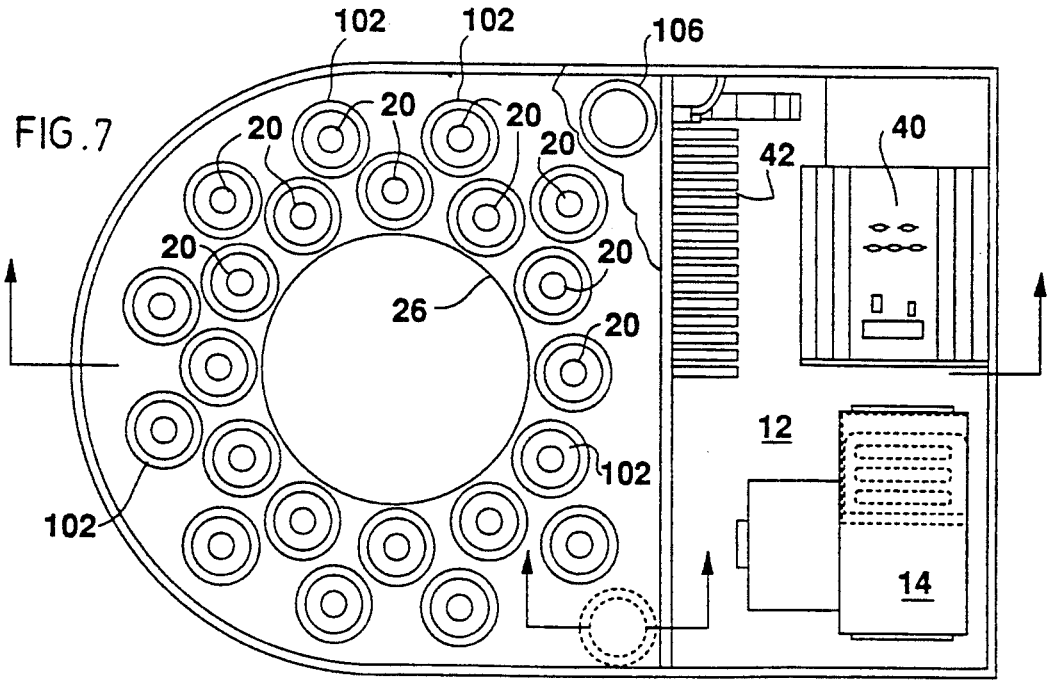
FIG. 7 is a view corresponding to FIG. 3 but illustrating the embodiment of FIG. 6.

The Embodiment of FIGS. 6 and 7

The fog generator illustrated in FIGS. 6 and 7 is very similar to that illustrated in FIGS. 1–5. To facilitate understanding, similar parts are correspondingly numbered.

In the fog generator of FIGS. 6 and 7 the common outer duct 30 is omitted. Instead, the housing includes a plurality of tubes 102 each overlying one of the transducers 20 for conducting the atomized liquid out of the housing. All of the tubes 102 are enclosed by the cover 7 having the outlet duct through which the generated fog is discharged.

More particularly, the fog generator includes a plate 104 which is fixed to the central gas inlet duct 26. Plate 104 is spaced over and closes the top of the reservoir 22. The tubes 102 are fixed to plate 104 in alignment with their respective transducers 20 such that the lower end of each tube is spaced slightly above the water within the reservoir 22 in alignment with its respective transducer. In the example illustrated in FIGS. 6 and 7, there are twenty-two transducers 20 arranged in a circular array around the inlet duct 26, and therefore there would be twenty-two tubes 102. This number can of course be increased or reduced; preferably, in the particular application described herein, there are at least ten transducers 20 each provided with one of the tubes 102.

The fog generator illustrated in FIGS. 6 and 7 also includes the dome-shaped deflector 28 of semi-spherical configuration fixed to the inlet duct 26 and of larger diameter than that duct. In this case, the open end of deflector 28 is secured to all the tubes 102, so that while the deflector also deflects the air from the inlet duct 26 towards the reservoir 22, this air does not actually enter compartment 21 containing the reservoir 22 but rather is deflected by plate 104 upwardly towards the discharge outlet.

Compartment 21 containing the reservoir 22 is supplied with the air via a pair of two further inlet ducts 106 passing through partition 10*b* from the lower compartment 24 into the reservoir compartment 25 and terminating below plate 104 securing the tubes 102. This air is deflected by plate 104 back towards the surface of the water in reservoir 22, as shown by the arrows in FIG. 6, and flows through the tubes 102 to pick up the liquid atomized by the transducers 20.

It will thus be seen that part of the gas from the gas compartment 24 enters the reservoir compartment 21 and flows through the tubes 102 as it picks up liquid atomized by the transducers 20. Another part of the gas flows through the central duct 26, is deflected downwardly by deflector 28 towards plate 104, and then upwardly out through the discharge outlet in cover 7, as it also picks up and mixes with the liquid atomized by the transducers 20 exiting from the tubes 102.

It has been found that such an arrangement produces very large quantities of fog for the relative size of the unit.

The fog generator illustrated in FIGS. 6 and 7 is otherwise constructed and operates in substantially the same manner as described above with respect to FIGS. 1–5.

It will be appreciated that many further variations may be made. For example, the float-operated valve and the reed switch (32 and 44, respectively, may be replaced by other forms of liquid level detectors, such as electrical detectors. In addition, the air blower 14 may be disposed outside of the housing enclosed by cover 4.

Many other variations, modifications and applications of the invention will be apparent.

What is claimed is:

1. A fog generator, comprising:

a housing including a reservoir for a liquid to be atomized;

a plurality of ultrasonic transducers disposed in spaced relation to each other in said reservoir so as to be submerged within the liquid therein;

and gas directing means for directing a flow of gas across the liquid in the reservoir;

said gas directing means including a gas inlet duct extending through said reservoir, and a dome-shaped deflector overlying, and of larger diameter than, said gas inlet duct to deflect the gas flowing through said duct back towards the reservor to pick up liquid atomized by said transducers.

2. The fog generator according to claim 1, wherein said ultrasonic transducers are disposed in a circular array, and said gas inlet duct extends through said circular array of transducers.

3. The fog generator according to claim 1, wherein the outlet end of the inlet duct is of cylindrical configuration, and the dome-shaped deflector is of semi-spherical configuration and of larger diameter than the outlet end of said inlet duct.

4. The fog generator according to claim 1, wherein said reservoir includes a plurality of baffles fixed in the reservoir in the spaces between the ultrasonic transducers to suppress the formation of waves in the liquid between the ultrasonic transducers.

5. The fog generator according to claim 1, wherein said housing further includes a conically-shaped outlet duct having its larger diameter end circumscribing the ultrasonic transducers and overlying the reservoir so as to receive, and to return to the reservoir, large droplets of the liquid atomized by the ultrasonic transducers.

6. The for generator according to claim 1, wherein said gas directing means further includes a gas chamber defined by a partition to which said ultrasonic transducers are fixed, said inlet duct passing through said partition to direct the flow of gas from said gas chamber into said reservoir.

7. The fog generator according to claim 6, wherein said housing further includes a blower located in a blower compartment laterally of said reservoir and gas compartment, and communicating with said gas compartment.

8. The fog generator according to claim 7, wherein said blower compartment is defined by a second partition also defining an electrical circuitry compartment including electrical drivers for said ultrasonic transducers, the gas being directed from said blower compartment to the gas compartment to also cool the electrical circuitry components in said electrical circuitry compartment.

9. The fog generator according to claim 8, wherein additional electrical components are located in said blower compartment, said housing including a gas inlet to the blower located so as to draw the air past said other electrical components to cool them before the gas arrives at said gas inlet.

10. The fog generator according to claim 8, wherein each of said electrical devices is disposed in a shielded housing in said electrical circuitry compartment, and is connected to its respective ultrasonic transducer in the reservoir by a shielded cable electrically connected to its respective shielded housing.

11. A fog generator, comprising :

a housing including a reservoir for a liquid to be atomized;

a plurality of ultrasonic transducers disposed in spaced relation to each other in said reservoir so as to be submerged within the liquid therein;

gas directing means for directing a flow of gas across the liquid in the reservoir;

and a plurality of baffles fixed in the reservoir in the spaces between the ultrasonic transducers to act as barriers suppressing the formation of waves in the liquid between the ultrasonic transducers;

said ultrasonic transducers being disposed in a circular array, and said baffles also being disposed in a circular array between the ultrasonic transducers.

12. The fog generator according to claim 11, wherein said reservoir is of annular configuration, and said gas directing means includes a gas inlet centrally of said reservoir and said circular array of ultrasonic transducers therein.

13. The fog generator according to claim 12, wherein said gas inlet includes an inlet duct coaxial with said circular array of ultrasonic transducers and having an outlet end above the level of the liquid in the reservoir; and wherein said generator further includes a dome-shaped deflector overlying, and of larger diameter than, said inlet duct so as to deflect the gas flowing therethrough back to the liquid in the reservoir to pick up the liquid atomized by the ultrasonic transducers.

14. The fog generator according to claim 13, wherein the outlet end of the inlet duct is of cylindrical configuration, and wherein the dome-shaped deflector is of semi-spherical configuration and of larger diameter than the outlet end of said inlet duct.

15. A fog generator according to claim 11, wherein the housing includes a plurality of tubes each overlying one of said transducers for conducting the atomized liquid out of said housing.

16. The fog generator according to claim 15, wherein there are at least ten transducers and ten of said tubes each overlying one of said transducers.

17. The fog generator according to claim 15, wherein said tubes are carried by a plate which is spaced over and closes the top of said reservoir.

18. The fog generator according to claim 17, wherein said gas directing means includes at least one further gas inlet duct for directing the gas into the space between said plate and said reservoir.

19. The fog generator according to claim 18, wherein there are at least two of said further gas inlet ducts.

* * * * *